US005094708A

United States Patent [19]

Bechtel et al.

[11] Patent Number: 5,094,708

[45] Date of Patent: Mar. 10, 1992

[54] REGISTRATION SYSTEM FOR A CONTINUOUS WEB

[75] Inventors: W. Jeffrey Bechtel, Hatboro; Robert A. E. Griebel; Robert J. Lawler, III, both of Warminster; Robert J. Lawler, IV, Southampton, all of Pa.

[73] Assignee: Graphic Communications, Inc., Harboro, Pa.

[21] Appl. No.: 573,709

[22] Filed: Aug. 28, 1990

[51] Int. Cl.[5] ..... B31F 1/28

[52] U.S. Cl. ..... 156/351; 156/361; 156/462; 156/470; 493/24; 493/29

[58] Field of Search ..... 156/351, 361, 462, 470; 493/24, 29, 463

[56] References Cited

U.S. PATENT DOCUMENTS

| | | | |
|---|---|---|---|
| 2,785,717 | 3/1957 | Knowles | 493/463 |
| 4,174,237 | 11/1979 | Hemming et al. | 156/361 |
| 4,196,046 | 4/1980 | McConnel | 493/463 |
| 4,284,445 | 8/1981 | Shimizu | 156/351 |
| 4,496,417 | 1/1985 | Haake et al. | 156/361 |
| 4,627,831 | 12/1986 | Hirakawa et al. | 156/470 |
| 4,642,087 | 2/1987 | Hoffmann | 493/463 |
| 4,704,171 | 11/1987 | Thompson et al. | 156/361 |

*Primary Examiner*—William E. Terrell
*Attorney, Agent, or Firm*—Gregory J. Gore

[57] ABSTRACT

A self-correcting web registration system achieves web shortening by pleating the web with a grooved crease roller. The web passes through a nip between the crease roller and an opposing drive roller which has an elastomeric cover. When web shortening is required and the web is being pleated by the crease roller, the opposing elastomeric roller is overdriven with respect to the normal advancement rate of the web. Further web shortening may be achieved by selectively increasing pressure between the crease roller and the elastomeric drive roller which causes the pleats in the web to become deeper. The crease roller may be used in conjunction with a tension roller which can be selectively engaged to stretch the web and achieve lengthening. Both rollers may be mounted in a single chassis which pivots relative to a frame-mounted drive roller. This provides selective engagement of either the tension or crease roller, depending upon the position of the chassis. The chassis is moved by a variable pressure actuator which is signaled by an electronic controller which senses web misregistration at the process point.

13 Claims, 3 Drawing Sheets

REGISTRATION SYSTEM FOR A CONTINUOUS WEB

FIELD OF THE INVENTION

The present device relates to a registration system where a continuous web is joined to a second structure, such as another web or packaging. More specifically, it relates to lamination of a continuous web with a second continuous web of pre-formed pouches to form a completed package for articles placed in the pouches.

BACKGROUND OF THE INVENTION & DESCRIPTION OF PRIOR ART

There has long been the requirement for laminating separate, continuous webs together while controlling the longitudinal alignment or registration between the webs so that they are joined at a desired point. Most often this occurs in systems requiring the repetition or repeating of a structure or printed pattern on one web, with corresponding structure or pattern on the second web. The length of the respective patterns is called the repeat length. The repeat length of one web is often held constant and used as the reference for the other web. This is called the "design repeat length". The printed pattern on the second web to be adjusted to the design repeat length is called the "actual repeat length" of that web. Proper registration between two joined webs require that the actual repeat length be maintained equal to the design repeat length.

The use of a pre-printed material in a continuous web form is desired for its economy; however, because the web is of one continuous length and is not cut until after it is laminated, there is a problem with adjusting the actual repeat length to the design repeat length without stopping the process. This problem is most commonly overcome by making at least one web of a stretchable material and printing the repeat length on that web much shorter than the design repeat length. Tension is then applied to the stretchable material while it is running to make the under-dimensioned repeat length on that web greater, until it matches the actual design length required by the second web. It is known, therefore, to regulate the tension of a stretchable web to vary the design repeat length. In this way, adjustments can be made for inconsistencies in the production of the web and other manufacturing variables that require registration correction.

A problem exists, however, because some types of web materials, such as aluminum foil, are only marginally stretchable. This permits a very limited range of adjustment by web stretching. There has long been sought a way to change the actual repeat length of a pre-formed, continuous web while in motion with respect to a pre-formed second web when neither of the webs is easily stretchable.

Prior art patents which are considered relevant to but not anticipatory of the applicant's invention include: U.S. Pat. No. 3,762,125 to Prenna, entitled "Film Registration Apparatus"; U.S. Pat. No. 3,294,301 to Richter, entitled "Web Registration System"; U.S. Pat. No. 3,589,095 to James, entitled "Method and Apparatus for Registering Two Separate Webs of Wrapping Material"; and U.S. Pat. No. 4,704,171 to Thompson et al, entitled "Laminating Device with Paper Tension Control".

SUMMARY OF THE INVENTION

In order to solve the unfulfilled need described above, the present system has been devised where the laminating web is subjected to a crease roller which gathers lateral pleats into the web, thereby shortening it longitudinally. These pleats easily take a permanent set, especially if the web is of a material such as aluminum foil. The creasing roller employs a plurality of circumferential lateral teeth and lateral grooves extending between said teeth substantially its entire length, equaling the width of the web.

In the present device, however, the roller opposing the creasing roller is motor driven at a speed greater than the process rate (overdriven). Hence, the web material gathers into the crease roller grooves and pleats are formed in the material. While some material deformation does occur, it represents a compression and accumulation of material, rather than a stretching. Hence, excess material is accumulated into a given length of web material as it is advanced past the creasing roller.

The amount of web shortening caused by the overdriven crease roller may also be regulated in part by changing the pressure of a creasing roller against an opposing deformable elastomeric roller. This changes the depth of the creases and, hence, the shortening effect on the web. As explained further herein, this system can be used alone or preferably in cooperation with the known web-stretching techniques described above. This permits greater control by reducing the degree of tension required on a marginally stretchable web. Because actual repeat length shortening can be achieved without greatly under-printing the laminating web, a much lower tension is required to make changes in the actual repeat length by combining both systems. When combining the two systems, a tension nip is employed to make the repeat length greater, while a creasing nip is employed to make the web length shorter.

The present device includes mechanical structures which employ the use of both of these systems in an easily controlled and compatible manner. As will be further described herein, a simple mechanical device permits selective employment of either the tension or creasing functions in a web treatment device consisting of specially designed rollers and an actuator. An electronic controller, with means to sense web misregistration, is employed to signal the drive speed or braking of a correction roller in the web treatment device. Simultaneously, the controller makes changes to a roller actuator which controls a mechanical shifter causing engagement/disengagement of either the tension or crease roller against the correction roller. By using this system, it has been found that registration can be greatly varied by creasing without unduly distorting the appearance of the laminating web. When unacceptable distortions do occur, they occur for only a short length of the treated web.

It is therefore an object of the present invention to create a repeat length regulating system for a preformed, marginally stretchable, continuous web.

It is a further object of the present invention to create a web treatment system whereby continuous preformed, stretchable webs may have repeat length regulation at very low tensions.

It is yet another object of the present invention to create a mechanical system of creasing and tensioninducing roller nips which can be regulated by a simple, economical, and easily controlled actuating mechanism.

Further objects and advantages will be readily apparent to those of ordinary skill in the art from the following drawings and description of the preferred embodiment.

DESCRIPTION OF THE PREFERRED EMBODIMENT

Figure 1:
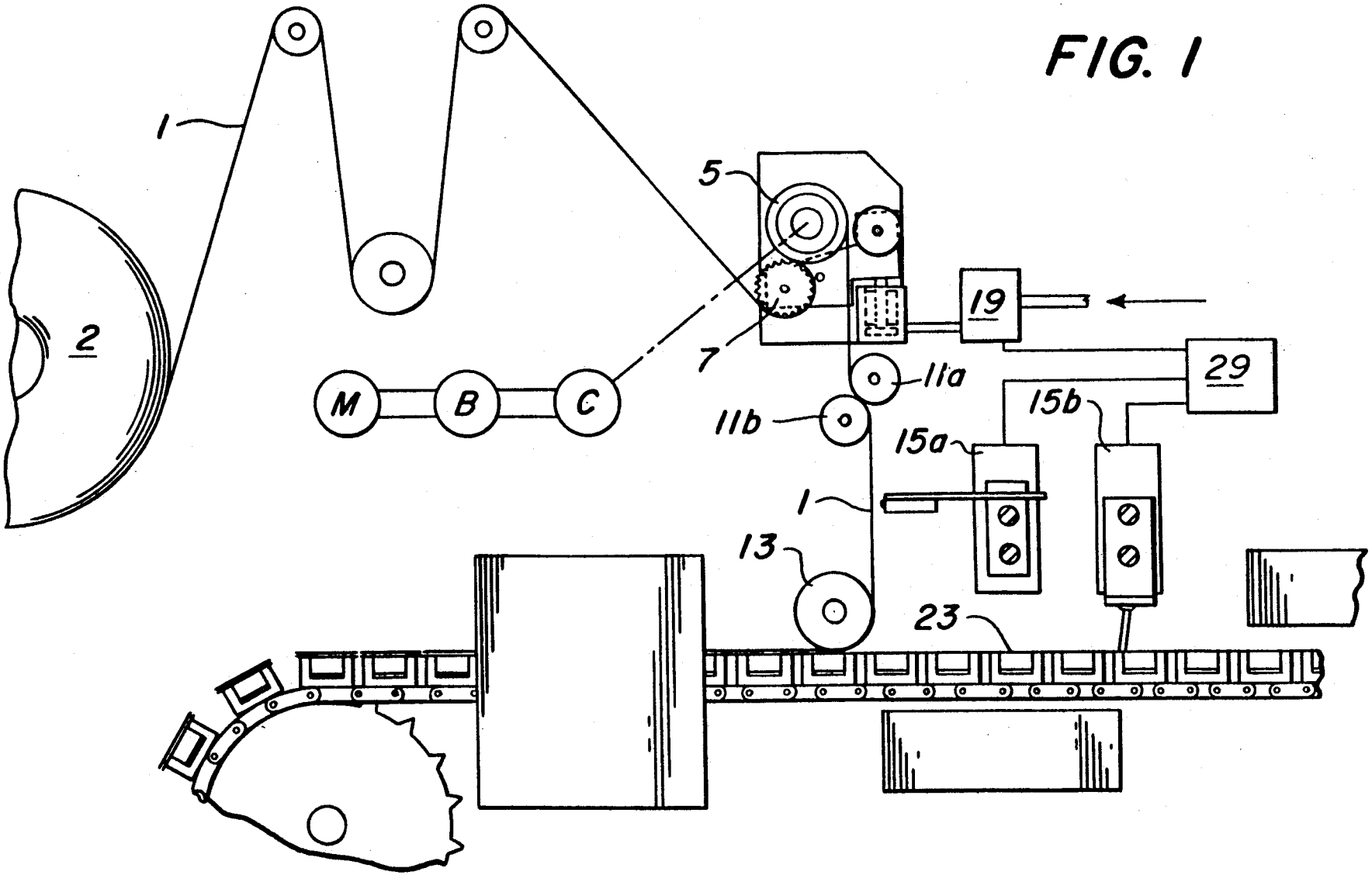
FIG. 1 is a diagram showing the location of the novel web treatment mechanism located within a typical package-forming machine.

Referring now to FIG. 1, the present web length treatment device is shown interposed between the feed roll 2 and the laminating roller 13 which meets package line web 23. The web treatment device is shown diagrammatically in this figure and comprises a roller shifter mechanism which captures the web against a speed controlled correction roller. A pre-printed or pre-formed laminating web 1 is fed from supply roll 2 counterclockwise over crease roller 7 and around the back side of elastomeric correction roller 5. The web then passes down between dancer rollers 11*a* and 11*b* down to laminating roll 13 which puts the treated web 1*a* into contact with package line 23.

Photo sensors 15*a* and 15*b* are disposed adjacent the laminating web and package lines to detect any misregistration therebetween. The sensors are electrically connected to a controller 29 which is, in turn, connected to pressure regulator 19.

Figure 2:
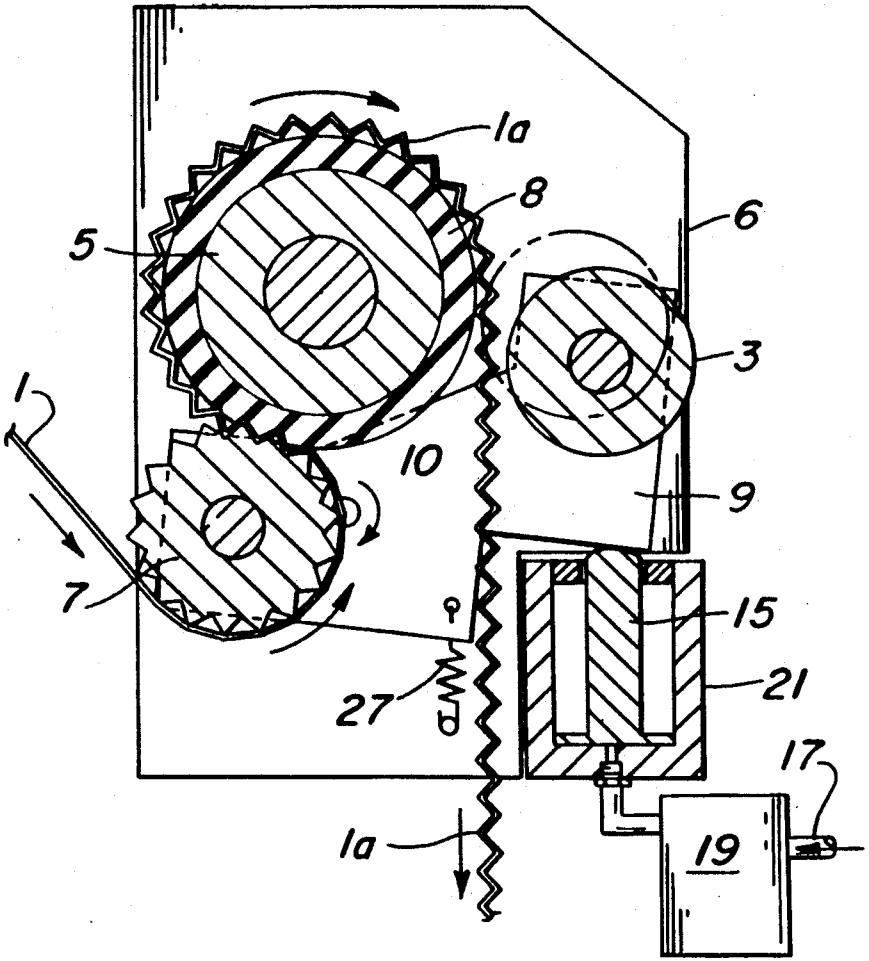
FIG. 2 is a side sectional view of the crease and tension roller actuating device.

Referring now to FIG. 2, a cross-sectional view of the web treatment device is shown in greater detail. Roller actuator 21 is an air cylinder which receives air from the pressure regulator 19 which is, in turn, connected to an air supply by conduit 17 as shown by the arrow in this figure. Air pressure moves piston 15 which bears against rocker chassis 9. The rocker chassis carries both the tension roller 3 and crease roller 7, which are freely rotatable thereon. The rocker chassis is pivotable about shaft 10 which is secured to frame 6 providing a shiftable mechanism between positions described below. The correction roller 5 is also rotatably mounted to frame 6 and is driven by motor means M shown in FIG. 1. The rocker chassis is biased in the clockwise direction by spring 27. It will be readily understood by those of ordinary skill in the mechanical arts that by increasing the air pressure behind piston 15, the crease roller 7 is moved out of contact with roller 5. And as pressure is further increased and rocker chassis 9 moves farther, tension roller 3 creates a nip which captures web 1 between itself and drive roller 5. By these mechanical relations, movement of the rocker chassis allows engagement of either the crease or tension roller selectively and individually.

Figure 3:
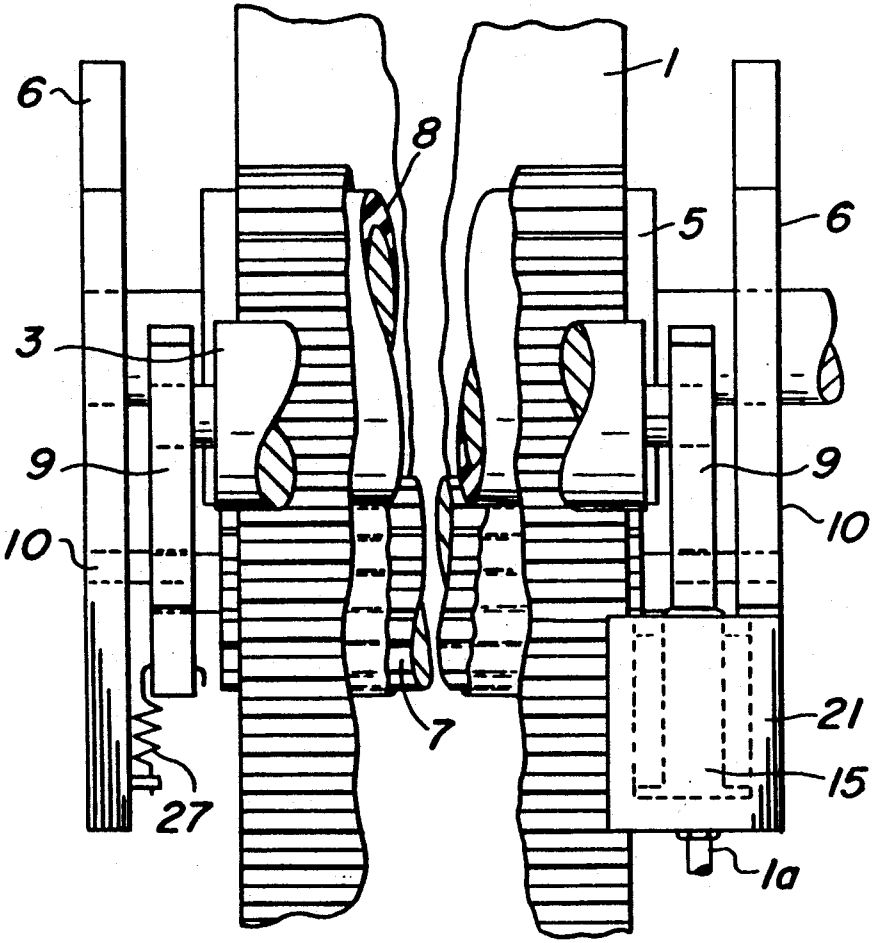
FIG. 3 is a top view of the crease and tension roller assembly.

Correction roller 5 includes an elastomeric cover 8 which deforms when pressed by the lateral grooves of crease roller 7 so that web 1 is thereby pushed into the recesses of the crease roller. This creates creases or pleats in the web as shown by the cross-section of the treated web 1*a* in FIG. 2. For the purposes of this drawing, the creases have been greatly exaggerated for illustrative purposes. In reality, the grooves are only about 0.015 inches deep and the correction roller has a diameter of approximately 2.5 inches. The number of grooves per inch can be in the range of 30 to 50 teeth when using a web of aluminum foil 0.003 inches thick. FIG. 3 is a top view of the device as shown from the side of FIG. 2. In this figure, the various structures can more easily be seen supported between frame end plates 6 on shafting which travels therebetween.

In an alternate embodiment, tension roller may also have teeth and grooves similar to the crease roller. It has been found that by using a creasing-type roller in place of a smooth surface roller to create tension that web stretching is enhanced with certain web materials. Because a crease-type roller in this location presses against the web when there is tension applied to either side of the nip, the force of the grooves into the web tend to stretch it, rather than pleat it.

Air pressure regulation to the roller actuator 21 of the web treatment device will place the combination of rollers in either of three functional positions (a) a position in which the correction roller is contacting tension roller 3; (b) a position in which the correction roller is in contacting relationship with crease roller 7; or (c) a position in which the correction roller is not contacting either the tension roller or the crease roller, or is contacting both simultaneously with only slight pressure. Once any of these positions is achieved, the correction roller is driven at an appropriate speed or braked. The correction roller speed is provided by suitable drive means; for example, the motor(M)—brake(B)—clutch(C) combination well-known in the web control arts, which is diagrammatically depicted in FIG. 1. The speed of the correction roller 5 can be varied by increasing electrical current to the clutch, which is signaled by an electronic controller to create varying amounts of registration correction as desired.

In each of the three aforementioned functional positions of the web treatment device, the way in which the system works will now be described in greater detail.

In the first of these three positions, a nip is created between tension roller 3 and the correction roller. In this position, the tension on the web may be increased by braking the correction roller 5 to make its linear surface speed slower than that of package line web 23. The amount of braking and the resulting tension is controlled by regulating electrical current to the clutch with the motor brake locked on. In this instance, the movement of the package line web will draw the laminating web at a speed greater than permitted by the nip between the tension roller and the correction roller, causing tension on the web therebetween to increase. This will cause web stretch and an increase in the actual repeat length at the laminating point.

The second position of the web treatment device mentioned above is where the correction roller 5 is in contacting relation with the crease roller 7 and is held away from tension roller 3. In this case, the correction roller 5 is driven by the motor means M at a linear surface speed greater than that of the laminating line 23 (over-driven). This overfeeds material which gathers and accumulates in the crease roller grooves as the web passes through the crease roller nip. As more clearly shown in FIG. 2, when the rollers are in this position, the grooves in the crease roller cause the web to be creased or pleated, thereby reducing its length.

In this second position, an extra degree of web shortening can be achieved by decreasing roller actuator pressure yet further. As pressure is decreased in this position of the rocker chassis, the force of spring 27 is more greatly transferred to the nip point between these rollers causing even greater deformation into the elastomeric surface of correction roller 5. Thus, the creases or pleats in the web become deeper and, hence, the length of the web is even shorter. In this way, varying the pressure to roller actuator 21 after the rocker chassis has been moved to this second position causes greater shortening of the treated web.

In the third functional position of the rocker chassis, there is no strong nip created between the correction roller and either other roller, hence, the laminating web is pulled evenly at little or no tension through to the laminator. To keep the movement of the rocker chassis to a minimum, the rollers are preferably dimensioned so that both the crease and the tension rollers are simultaneously in contact with the correction roller, but there is only slight pressure between the elastomeric surface of the correction roller and either roller in both nips. With this arrangement, the web is never completely released from both nips at the same time. A minimal amount of tension is provided between dancer roll 12 and tension rollers 11*a* and 11*b* to control lateral drift of the web. In this third position, the correction roller may be signaled by the controller to free wheel or be driven at the process rate. In this instance, the pre-printed repeat length remains unchanged.

In summarizing the explanation above, the various structures of the web treatment device cooperate so that by varying the speed of correction roller 5 and the air pressure fed to roller actuator 21, the length of web 1 can either be stretched or shortened in order to vary registration with package line web 23 as desired.

Figure 4:
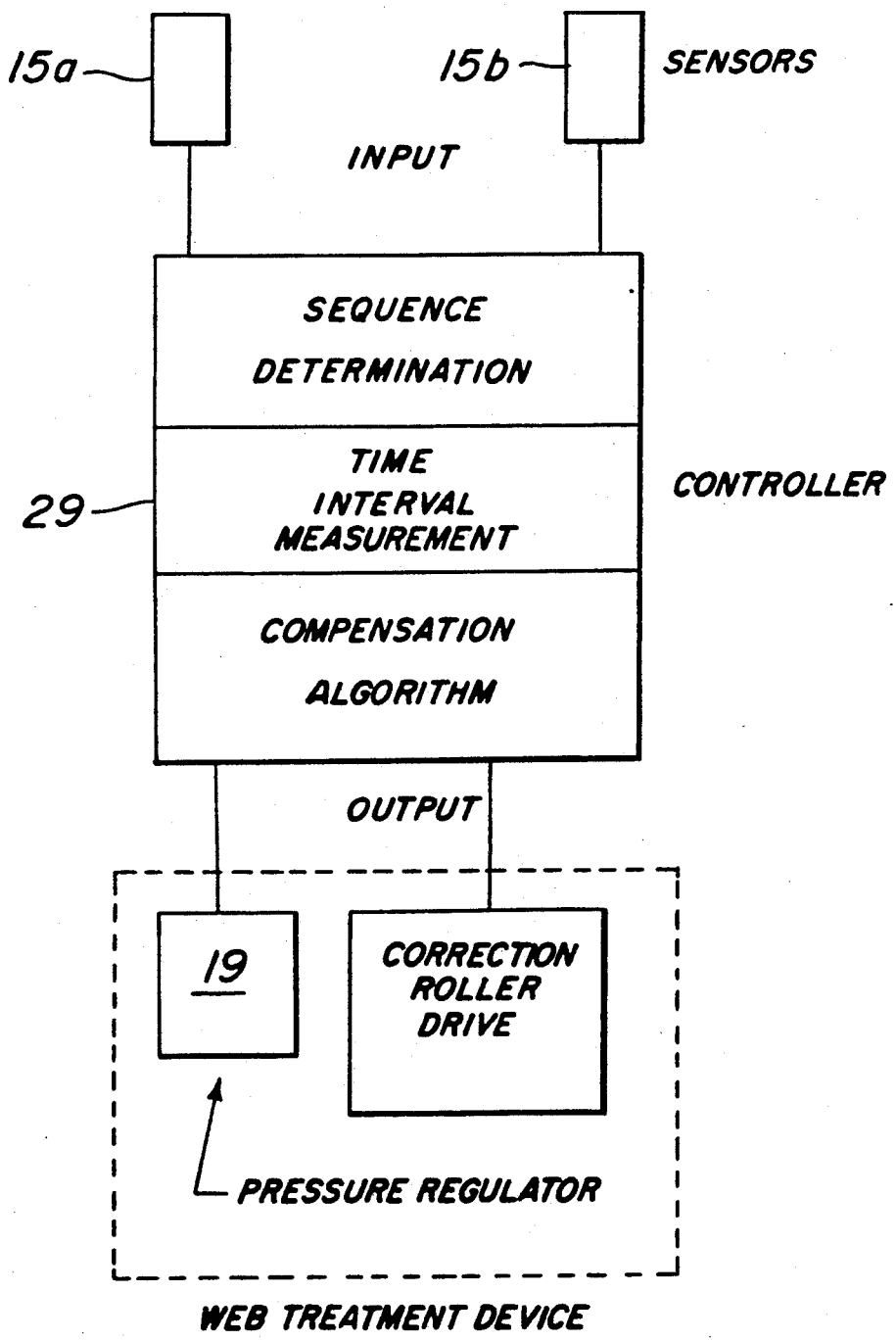
FIG. 4 is a circuit diagram showing connection of controller circuitry between the sensors and the web treatment device.

The correction roller speed and the air pressure supplied to the web treatment mechanism is determined by a controller which is signaled by sensors 15*a* and 15*b* as shown in FIG. 4. The sensors are triggered by web markings on both the laminating web and the packaging line web which are equally spaced the same distance apart on each web. The photo sensors are positioned such that proper registration occurs when both sensors are triggered by their respective markings simultaneously.

As shown in FIG. 4, the sensors are connected to an electronic controller 29 having circuitry which determines the order in which the sensors fire and the time interval between them. The firing order determines the direction of the correction needed, while the time interval determines the amount. These parameters are inputed to an algorithm derived from experimentation which varies the correction roller speed and air pressure to cause the desired compensation. These two variables regulated by the controller determine the shortening or lengthening of the laminating web to bring the lamination into correct registration.

The controller circuitry is shown in FIG. 4 diagrammatically and in general terms. Particular circuitry that may be employed to achieve a programmable controller which functions as invented by the applicant and explained diagrammatically herein is well-known. Thus, the particular circuits and electronic components may be chosen from among many suitable devices known to those in the electronic arts.

OPERATION

If the registration sensors indicate that the lamination web is advanced with regard to the package line web, then the roller pressure actuator and drive motor are activated simultaneously as follows. The air pressure is increased to the roller actuator until the bias spring is overcome to the point where the tension roller 3 is in contact with the correction roller and the web is firmly gripped therebetween. With the motor brake engaged the electrical supply to the clutch of the correction roller is increased to retard the speed of the laminating web so that it advances at a rate slower than the speed of the package line web. Hence, a tension is created in the web between the tension roller and the laminating point by the draw of the advancement of the package line web. This tension then increases the length of the web by stretching. Thus, markings or particular portions on the laminating web are thereby placed at a point on the packaging line web behind where they would have fallen without the increased tension. This creates the required positional retarding required to compensate for the advanced condition detected.

Conversely, if the sensors detect that the laminating web is retarded with regard to the packaging line, then the controller responds as follows. The correction drive roller is signaled to be driven by the motor at a speed greater than the advancement of the package line (overdriven). In this mode, the motor is driven at a constant high speed and clutch current is increased to achieve the desired degree of overdrive. Simultaneously, the air pressure is reduced to the roller actuator. Now the rocker chassis bias spring overcomes the air pressure and shifts the rocker chassis so that the crease roller is in firm contact with the correction roller. This causes creases or pleats to form in the web which, as described in detail above, causes shortening of the web. Hence, pre-printed areas of the web are caused to fall at points on the packaging line web ahead of where they would normally be placed. In this way, the detected retarded condition is corrected.

As above described, when the sensors detect either advanced or retarded condition of the laminating web, the required corrections are performed and the system becomes self-correcting. Electrical current to the clutch and changes to the roller actuator pressure are the variables regulated by the controller to achieve these results. Precise registration between the laminating web and the package line may therefore be achieved and maintained by a controller properly programed to carry out the desired changes to the correction roller drive and roller actuator air pressure.

It should be understood by those of ordinary skill in the art that many of the simple, mechanical structures described in the preferred embodiment may have many alternatives which achieve the same result. For example, the correction roller in the preferred embodiment is controlled by a drive motor mechanically connected in combination with a clutch and a brake. In this instance, the speed of the correction roller is controlled by the electrical supply to the clutch and brake which causes the drive system to either overdrive or brake the roller. However, other suitable variable speed drives may be used. Similarly, the preferred registration controller may be replaced by other misregistration detection and control systems using other types of sensors and circuitry well-known in the arts. The particular embodiments shown herein are for purposes of illustration and are but one method of carrying out the invention. There may be other modifications and changes obvious to those of ordinary skill in the art which fall within the scope of the present invention which should be limited only by the following claims and their legal equivalents.

What is claimed is:

1. A laminator, including a device for controlling the registration of a first continuous web with respect to a second continuous web to which it is laminated, comprising:

a) a laminator feeding and joining first and second moving continuous webs at a laminating point;

b) a crease roller rotatably mounted in a frame on said laminator and in lateral contacting relationship with said first web;

c) a second roller rotatably mounted in said frame, which creates a nip with said crease roller holding said first web therein;

d) said crease roller having a length equal to the width of said first web and including a plurality of circumferential lateral teeth and lateral grooves between said teeth, said teeth and grooves extending substantially the entire width of said crease roller; and, e) means for selectively varying the speed of said second roller with respect to the speed of the second web such that lateral creases are formed in said first web having a depth which is a function of the speed of the second roller, thereby selectively changing the relative longitudinal position between said first and second webs at said laminating point.

2. The laminator of claim 1 wherein said second roller includes an elastomeric cover.

3. The laminator of claim 2 further including a tension roller mounted in said frame and selectively engagable with said first web, said first web being captured in a nip between said tension roller and said second roller whereby the speed of said second roller is retarded when said tension roller is engaged, thereby increasing the tension of said first web.

4. The laminator of claim 3 wherein said tension roller and said crease roller are rotatably mounted on a rocker chassis which pivots in said frame relative to said second roller, said rocker chassis moved by a roller actuator whereby the motion of said rocker chassis causes said crease roller and said tension roller to be selectively engaged alternatively with said second roller.

5. The laminator of claim 3 wherein said second roller includes speed control means providing roller speeds for overdriving or retarding said second roller with respect to the speed of said second web.

6. The laminator of claim 5 further including two sensors, one on each web, which detect misregistration between said first and said second webs, said sensors connected to a controller programed to vary the speed of said driving means and the position of said roller actuator to either stretch said first web or crease and overdrive said first web to compensate for any misregistration which is sensed.

7. The laminator of claim 6 wherein said controller includes electronic circuits which detect the sequence and time delay between sensor signals to determine the direction and amount of registration compensation needed.

8. The laminator of claim 7 wherein said roller actuator is in fluid communication with and driven by a pressure regulator signaled by said electronic controller whereby a variable pressure level between said crease roller and said second roller may be exerted selectively as determined by said controller, said pressure level changes causing changes in the depth of creases formed in said first web by said crease roller thereby changing the length of said webs.

9. The laminator of claim 3 wherein said tension roller includes alternating peripheral teeth and grooves extending substantially the entire length of said tension roller.

10. The laminator of claim 1 further including two sensors, one on each web, which detect misregistration between said first and said second webs, said sensors connected to a controller programed to vary the speed of said second roller.

11. The laminator of claim 1 wherein of said first web includes printing thereon and the action of said crease roller against said first web causes only slight visible distortion of said printing such that words and other characters printed on said web may be easily read after lamination.

12. The laminator of claim 11 wherein said grooves are approximately 0.015 inches deep, and the pitch of the grooves is in the range of 30 to 50 teeth per inch.

13. The laminator of claim 12 wherein said first web is composed of metal foil.

* * * * *